US007159796B2

(12) United States Patent
Yquel

(10) Patent No.: US 7,159,796 B2
(45) Date of Patent: Jan. 9, 2007

(54) DEVICE FOR SPRAYING A SUBSTANCE ONTO A MEDIUM

(75) Inventor: Jean-Pierre Yquel, Colombes (FR)

(73) Assignee: L'Oreal, Paris (FR)

( * ) Notice: Subject to any disclaimer, the term of this patent is extended or adjusted under 35 U.S.C. 154(b) by 39 days.

(21) Appl. No.: 10/265,695

(22) Filed: Oct. 8, 2002

(65) Prior Publication Data

US 2003/0085302 A1 May 8, 2003

(30) Foreign Application Priority Data

Oct. 11, 2001 (FR) ..... 01 13098

(51) Int. Cl.

| | |
|---|---|
| ***A62C 13/62*** | (2006.01) |
| ***A62C 13/66*** | (2006.01) |
| ***A62C 31/00*** | (2006.01) |
| ***B05B 7/10*** | (2006.01) |
| ***F23D 11/46*** | (2006.01) |

(52) U.S. Cl. ..... 239/340; 239/291; 239/303; 239/306; 239/398; 239/406; 239/414

(58) Field of Classification Search ..... 239/290–301, 239/306, 314, 337, 418, 340, 398, 401, 414, 239/406; 222/399, 402.13, 402.15
See application file for complete search history.

(56) References Cited

U.S. PATENT DOCUMENTS

| | | | | |
|---|---|---|---|---|
| 1,430,506 | A | 9/1922 | Holton | |
| 1,603,612 | A | 10/1926 | Krautzberger | |
| 2,196,800 | A | 4/1940 | Krautzberger | |
| 2,635,921 | A | 4/1953 | Deutsch | |
| 2,930,532 | A | 3/1960 | Johnson | |
| 3,043,524 | A | 7/1962 | Boris et al. | |
| 3,085,752 | A | 4/1963 | Drell | |
| 3,240,396 | A | 3/1966 | Friedenberg | |
| 3,289,949 | A | 12/1966 | Roth | |
| 3,300,144 | A | 1/1967 | Marraffino | |
| 3,305,134 | A | 2/1967 | Carmichael et al. | |
| 3,524,589 | A | 8/1970 | Pelton, Jr. | |
| 3,554,521 | A * | 1/1971 | Rhydderch | 266/158 |
| 3,589,618 | A | 6/1971 | Thornton et al. | |
| 3,591,088 | A | 7/1971 | Green | |
| 3,675,824 | A | 7/1972 | Hein | |
| 3,680,740 | A | 8/1972 | Kinnavy | |
| 3,746,253 | A * | 7/1973 | Walberg | 239/705 |
| 3,830,631 | A | 8/1974 | Young et al. | |
| 4,015,753 | A * | 4/1977 | Bennett | 222/633 |

(Continued)

FOREIGN PATENT DOCUMENTS

| | | |
|---|---|---|
| CA | 2152406 | 12/1996 |

(Continued)

OTHER PUBLICATIONS

U.S. Appl. No. 09/999,860, filed Oct. 23, 2001.

(Continued)

*Primary Examiner*—Davis Hwu
(74) *Attorney, Agent, or Firm*—Oblon, Spivak, McClelland, Maier & Neustadt, P.C.

(57) ABSTRACT

A device for spraying at least one substance onto a medium includes a supply of vector gas, a substance feed in communication with a supply of the substance and at least one shutter which interrupts communication between the substance feed and the supply of substance. The substance can be sucked from the supply by suction established in the vicinity of the substance feed by emission of the vector gas. The vector gas is emitted from at least one gas outlet orifice located in the vicinity of the substance feed.

56 Claims, 2 Drawing Sheets

U.S. PATENT DOCUMENTS

| | | | | | |
|---|---|---|---|---|---|
| 4,171,084 | A | | 10/1979 | Smith | |
| 4,174,084 | A | | 11/1979 | Matsuo et al. | |
| 4,219,157 | A | * | 8/1980 | Binoche | 239/296 |
| 4,251,032 | A | | 2/1981 | Werding | |
| 4,260,110 | A | | 4/1981 | Werding | |
| 4,676,216 | A | * | 6/1987 | Ohsawa et al. | 123/533 |
| 4,681,262 | A | | 7/1987 | Sprute | |
| 4,798,336 | A | * | 1/1989 | Ilott | 239/337 |
| 4,844,003 | A | * | 7/1989 | Slautterback et al. | 118/323 |
| 5,046,667 | A | * | 9/1991 | Fuhrig | 239/124 |
| 5,082,652 | A | | 1/1992 | Mayfield et al. | |
| 5,115,972 | A | * | 5/1992 | Maier et al. | 239/8 |
| 5,125,546 | A | | 6/1992 | Dunne et al. | |
| 5,255,852 | A | | 10/1993 | Morrison | |
| 5,346,135 | A | * | 9/1994 | Vincent | 239/306 |
| 5,452,856 | A | * | 9/1995 | Pritchard | 239/297 |
| 5,643,672 | A | | 7/1997 | Marchi et al. | |
| 5,676,310 | A | * | 10/1997 | Hynds | 239/8 |
| 5,685,482 | A | * | 11/1997 | Sickles | 239/3 |
| 5,695,096 | A | | 12/1997 | Yquel | |
| 5,713,519 | A | | 2/1998 | Sandison et al. | |
| 5,810,252 | A | | 9/1998 | Pennamen et al. | |
| 5,945,085 | A | | 8/1999 | Salas et al. | |
| 5,954,273 | A | | 9/1999 | Ruta et al. | |
| 5,957,333 | A | * | 9/1999 | Losenno et al. | 222/95 |
| 6,098,846 | A | * | 8/2000 | Yazawa et al. | 222/95 |
| 6,168,781 | B1 | * | 1/2001 | Ukaji et al. | 424/70.11 |
| 6,264,113 | B1 | | 7/2001 | Dingler | |
| 6,328,950 | B1 | | 12/2001 | Franzke et al. | |
| 6,425,533 | B1 | * | 7/2002 | Shilton et al. | 239/290 |
| 6,433,068 | B1 | | 8/2002 | Morrison et al. | |
| 6,520,377 | B1 | | 2/2003 | Yquel | |
| 6,589,509 | B1 | | 7/2003 | Keller et al. | |
| 6,685,926 | B1 | | 2/2004 | Hehner et al. | |
| 2002/0104898 | A1 | | 8/2002 | Bonningue et al. | |
| 2003/0085302 | A1 | | 5/2003 | Yquel | |

FOREIGN PATENT DOCUMENTS

| | | | |
|---|---|---|---|
| DE | 534273 | | 9/1931 |
| DE | 3517122 | | 5/1986 |
| EP | 0 014 993 | | 9/1980 |
| EP | 0 208 247 | | 1/1987 |
| EP | 1004288 | | 5/2000 |
| EP | 1201317 | | 5/2002 |
| FR | 600 203 | | 2/1926 |
| FR | 1 280 048 | | 12/1961 |
| FR | 1 309 435 | | 10/1962 |
| FR | 1 449 794 | | 5/1966 |
| FR | 2644369 | | 9/1990 |
| FR | 2 781 208 | | 1/2000 |
| FR | 2785594 | | 5/2000 |
| GB | 780885 | | 8/1957 |
| JP | 32-8363 | | 8/1957 |
| JP | 49-95511 | | 8/1974 |
| JP | 50-8532 | | 4/1975 |
| JP | 50-8803 | | 4/1975 |
| JP | 51-34713 | | 3/1976 |
| JP | 57-76754 | | 5/1982 |
| JP | 1027659 | | 1/1989 |
| JP | 408210280 | A * | 8/1996 |
| JP | 3039520 | | 5/1997 |
| JP | 10-127336 | | 5/1998 |
| WO | WO 89/09170 | | 10/1989 |

OTHER PUBLICATIONS

Pending U.S. Appl. No. 10/203,781, filed Aug. 14, 2002
Pending U.S. Appl. No. 10/265,695, filed Oct. 8, 2002.

* cited by examiner

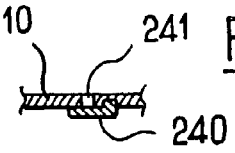
FIG_10
FIG_3
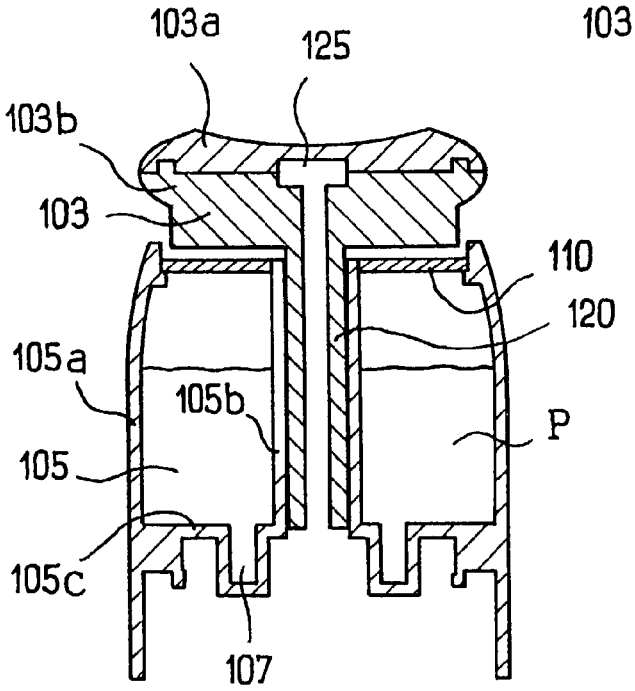
FIG_4
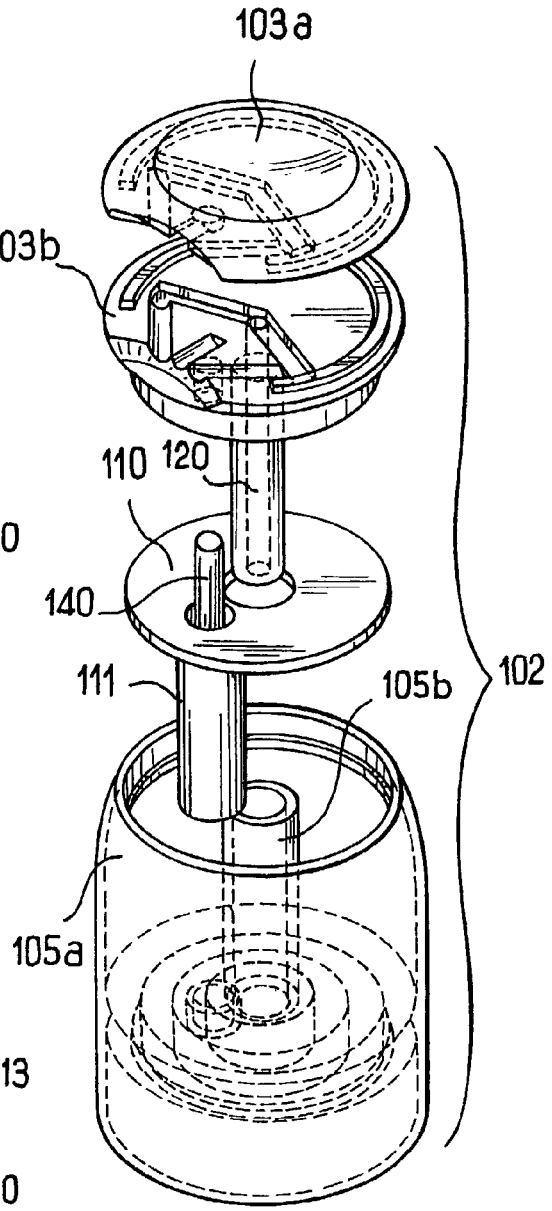
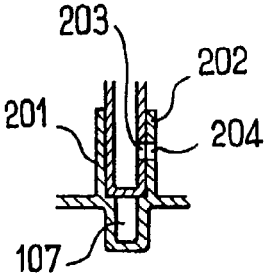
FIG_6
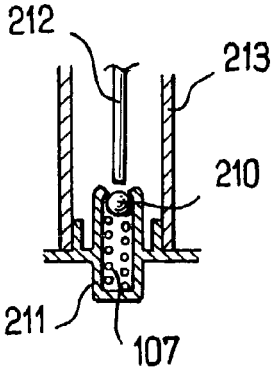
FIG_7
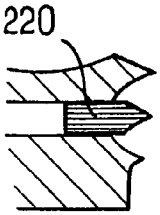
FIG_8

DEVICE FOR SPRAYING A SUBSTANCE ONTO A MEDIUM

CROSS-REFERENCE TO RELATED APPLICATIONS

This document claims priority to French Application No. 01 13098 filed Oct. 11, 2001, the entire content of which is hereby incorporated by reference.

FIELD OF THE INVENTION

The present invention relates to a device for spraying a substance onto a medium, for example a keratinous medium such as the skin.

BACKGROUND OF THE INVENTION

The use of a vector gas for spraying paint is described in U.S. Pat. No. 2,635,921. This conventional technique has been thoroughly developed and constitutes the subject matter of numerous patent applications, such as European Patent Application No. EP-A1-0 208 247, U.S. Pat. No. 5,255,852 and U.S. Pat. No. 5,713,519.

Spray devices are presently available on the market under the trademark ECOSPRAY™. These devices are suitable for applying paint to a non-keratinous medium.

U.S. Pat. No. 1,430,506 discloses a spray device which includes a tank on which two nozzles are fixed. The nozzles are connected to a compressed air inlet and can emit air jets which meet in a region situated over a substance feed orifice. This device requires an external source of compressed air and a feed hose.

It is also known to apply makeup by using an airbrush having an applicator stylus connected to a cylinder of compressed vector gas. The applicator stylus includes a vector gas ejection nozzle and a cup containing the makeup to be applied. The makeup is sucked progressively via a duct into the cup by the suction created by the Venturi effect due to the speed of the vector gas leaving the nozzle. This type of airbrush can render the boundary between treated zones and non-treated zones less visible, thus producing blending and shading-off effects or impressions of volume. Hand action is also different since the makeup does not need to be spread out after it has been deposited on the keratinous medium. Makeup is thus applied very hygienically since application may be done without making contact with the fingers or with an applicator.

Such an airbrush is also disclosed in Canadian Patent Application No. CA-A-2 152 406, for example. Similar devices are sold by DINAIR under registered trademarks BEAUTY ART™ and BODY ART™, with the cylinder of compressed vector gas being replaced by an air compressor. In these conventional devices, the applicator stylus and the vector gas source do not constitute a unitary structure but they are interconnected by a hose. As a result, these devices are relatively bulky and are intended mainly for professional use. They cannot easily be carried around in a handbag, as are conventional makeup accessories.

French Patent Application No. FR-A-2 781 208 discloses a device having a unitary structure for spraying a composition onto a medium. The composition is selected from a plurality of compositions of different tones. The composition is sprayed by suction caused by a vector gas jet expanding in the vicinity of a substance feed member. The vector gas jet is emitted through a nozzle whose axis is contained in the same plane as the axis of the feed member.

OBJECTS AND SUMMARY OF THE INVENTION

The present invention provides a novel spray device which is self-contained, and has a structure that is relatively simple and low cost. In particular, the device is suitable for use in the field of cosmetics.

The invention thus provides a device for spraying at least one substance onto a medium. The device includes a supply of vector gas, at least one substance feed configured to be in fluid communication with a supply or reservoir of the substance. The substance is sucked from the supply by suction established in the vicinity of the at least one substance feed by emission of the vector gas.

According to an aspect of the invention, the device further includes at least one shutter configured to interrupt fluid communication between the at least one substance feed and the supply of substance. The substance feed can include at least one orifice. The substance feed can include at least one substance feed member, e.g., a member in which the substance can flow by capillary action or wicking, such as a felt, a foam, or a sintered member.

The invention improves the conditions under which the substance is conserved in the supply of substance. In particular, the invention can help prevent volatile components from escaping. The invention can also lower the risks of the substance leaking out while the device is being carried around in a horizontal or an upside-down position, as may happen, for example, in a handbag.

According to an aspect of the invention, the device can be adapted so as to reestablish fluid communication automatically between the substance feed and the substance supply whenever the vector gas is emitted. The device can also be adapted so that fluid communication is automatically interrupted whenever vector gas emission stops.

According to an aspect of the invention, the device can include a pushbutton configured to act simultaneously, whether directly or indirectly, on a vector gas dispenser valve and on the shutter so that fluid communication between the substance feed and the supply of substance is established when the user presses on the pushbutton to deliver the vector gas.

The supply of substance can be contained, for example, in a first receptacle fixed to a second receptacle containing the vector gas. The two receptacles can also have at least one portion in common, e.g., a partition defining at least two compartments respectively containing the vector gas and the substance to be sprayed.

The receptacle containing the substance and the receptacle containing the vector gas can be in fixed relationship, neither being capable of moving relative to the other in use. By way of example, this embodiment provides an assembly which is relatively compact and easy to carry around, for example, in a handbag.

The receptacle containing the substance can, for example, be annular in shape. The receptacle can define a passage, e.g., a central passage, along which a control member for a valve, which is fitted to the receptacle containing the vector gas, can extend.

The shutter can be operationally connected to at least one element actuated by moving the pushbutton of the device. Such an element can include a hollow rod, for example. The rod can define at least one internal passage enabling the substance contained in the supply of substance to reach the substance feed.

By way of example, the shutter can include at least one gasket suitable for closing at least one orifice through which the substance can flow to reach the substance feed. The gasket can be configured to release or uncover the orifice at least in part while the substance is dispensed.

In a particular embodiment, the shutter includes a gasket mounted on a hollow rod. The rod can be closed at its bottom end. The gasket can bear via its top face against a shoulder of the rod. The rod can be pierced by at least one substance admission orifice. The admission orifice can have a diameter smaller than or equal to the thickness of the gasket. The gasket can be configured to abut via its bottom face against a fixed bearing wall when the hollow rod is pushed down, so that the gasket is then compressed and disengages, or uncovers, the admission orifice at least in part, so as to allow the substance to flow towards the substance feed. By way of example, the gasket can also press via its periphery against the inside surface of a duct in which the hollow rod can move axially. The duct can be adapted to communicate freely with the outside, in which case the gasket provides a leak-tight closure of the gap situated between the hollow rod and the inside surface of the duct. The top end of the duct can connect to a cover closing the top of the substance containing receptacle, for example. The hollow rod can be actuated by moving the pushbutton that controls vector gas emission, for example. The inside space at the bearing wall against which the gasket can come into abutment via its bottom face can communicate with the receptacle containing the substance, e.g., via an annular channel formed in a bottom end wall of the receptacle. The above-mentioned duct can be connected in a leak-tight manner to the above-mentioned tubular bearing wall.

According to an aspect of the invention, the device can include a pushbutton made by assembling together a bottom portion and a top portion. The bottom portion can be made integrally with an actuator rod, for example, and can extend in a passage of the receptacle containing the substance, e.g., a central passage. The control rod for the valve delivering the vector gas can be engaged in the actuator rod of the pushbutton. The vector gas can be emitted via at least one gas outlet orifice.

In a particular embodiment, the vector gas is emitted via at least two gas outlet orifices, of respective positions and orientations such that the vector gas jets emitted by the orifices meet. The application characteristics can thus be improved. The gas outlet orifices can be disposed, for example, symmetrically about the spray axis.

The substance feed can include an orifice having an axis substantially in the same plane as the axes of the gas outlet orifices. The gas outlet orifices can be arranged so that the gas jets emitted by the orifices meet directly without being deflected on any deflector-forming element. Alternatively, at least one deflector-forming element can be provided. The gas outlet orifices need not have any swirl channels.

In a particular embodiment, the gas outlet orifices have axes which make an angle of about 45° with an axis of a substance feed orifice. The axis of this orifice, through which the substance is delivered, can coincide with the spray axis, for example.

The vector gas can be contained in liquefied form in the vector gas receptacle. This enables the device to be compact, or alternatively enables the device to operate for a longer time, e.g., twenty times longer than when using compressed air. The vector gas can also be emitted at constant pressure which improves the reproducibility of makeup performed using the device. The vector gas can be compatible with the spray device being used in cosmetics or dermatology.

At the inlet of the valve body, for example, the device can include an element enabling vector gas in gaseous form to pass, while preventing vector gas in liquefied form from passing. Such an element can include a block of sintered material, for example.

The substance which is sprayed can be a liquid, a liquid containing solid particles in suspension, or a powder that is sufficiently fine. The term "spray" should therefore be understood broadly as covering not only projecting liquid droplets, but also projecting dry particles, more commonly known as "dusting" or "blowing".

The receptacle containing the substance can be fixed on the receptacle containing the vector gas in removable manner, thus making it possible, for example, to use a common vector gas receptacle to spray a variety of substances. The receptacle containing the substance need not have any air intake duct. In a variant, the receptacle can include a mechanism that enable air to be admitted, such as, for example, a microleak or a valve capable of opening in the event of a drop in pressure in the receptacle. If a microleak is used, it can be configured to prevent substance from passing therethrough when the device is in a prone position.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 3 is a fragmentary and diagrammatic axial section on III—III of FIG. 2;

FIG. 4 is a fragmentary diagrammatic exploded perspective view of the FIG. 1 device;

FIGS. 6 and 7 are diagrams showing other examples of shutters;

FIG. 8 is a diagram of a member for feeding substance by capillarity;

FIG. 10 is a diagram showing an example of an air intake valve.

MORE DETAILED DESCRIPTION

Figure 1:
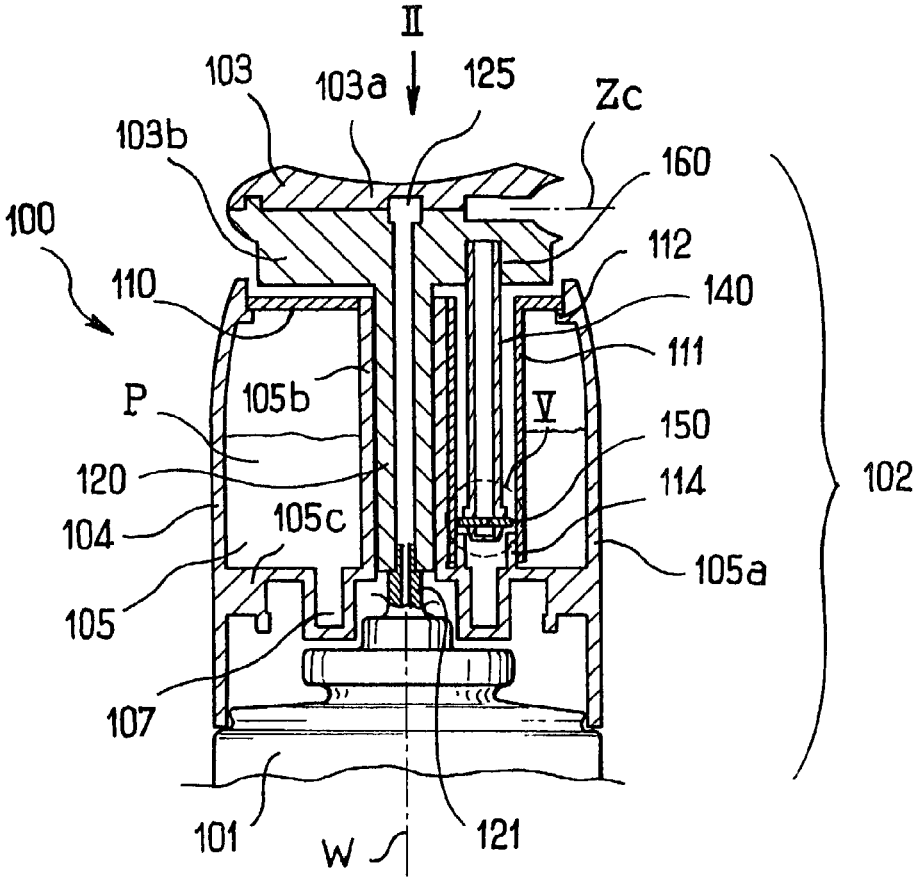
FIG. 1 is a fragmentary diagrammatic axial section on I—I of FIG. 2, showing an embodiment of a spray device in accordance with the invention.

The spray device 100 shown in FIG. 1 includes a pressurized receptacle 101 containing a vector gas in liquefied form, e.g. butane, isopropane, isobutane, or a fluorinated compound. The spray device 100 also includes a dispenser assembly 102 with a pushbutton 103 and a receptacle 104 containing a substance P, e.g. a liquid foundation makeup. By way of example, the substance P can be a liquid containing solid particles in suspension.

In the example described, the receptacle 104 has a cavity 105 that is generally annular in shape about an axis W. The cavity 105 contains the substance P and is defined radially on the outside by a first tubular wall 105*a* and radially on the inside by a second tubular wall 105*b*. The walls 105*a* and 105*b* are united at the bottom by a bottom end wall 105*c* which includes an annular channel 107 about the axis W, whose function is explained below.

The top of the cavity 105 is closed by a cover 110 with a duct 111 having its axis parallel to the axis W being connected to the bottom face of the cover. The cover 110 can bear against a shoulder 112 formed at the top end of the wall 105*a*.

The duct 111 extends over substantially the entire height of the cavity 105 and its bottom end is assembled to a wall 114 which projects upwards from the bottom wall 105*c* vertically over the channel 107. The duct 111 can be assembled to the wall 114 by engaging one within the other, for example. The above-mentioned wall 114 can be continuous or discontinuous, and for example it can be constituted by studs. The duct 111 and the cover 110 can also be formed integrally, for example.

The pushbutton 103 is made, for example, by assembling together a top portion 103*a* and a bottom portion 103*b*. In the example shown, the bottom wall is formed integrally with a hollow rod 120 for actuating a valve of the pressurized receptacle 101, the rod being capable of sliding inside the wall 105*b*. This valve can itself have a hollow control rod 121 engaged in a leak-tight manner in the bottom end of the rod 120, and bearing via a shoulder against the bottom end face of the rod 120.

Figure 2:
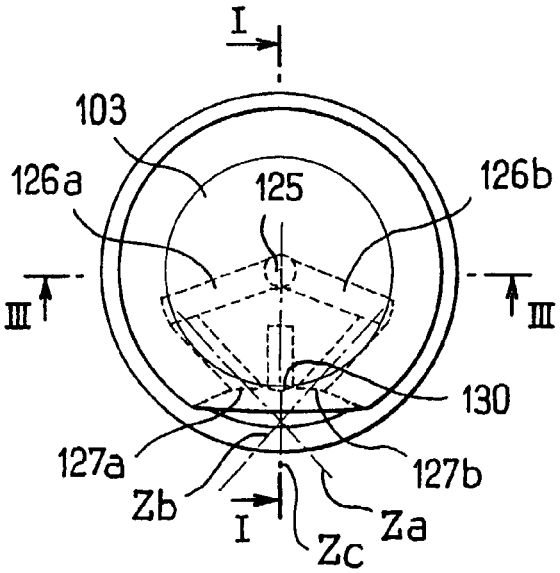
FIG. 2 is a diagrammatic and fragmentary plan view as seen looking along arrow II in FIG. 1.

The pushbutton 103 can be moved along the axis W to act on the control rod 121, thus causing the vector gas to flow along the duct inside the rod 120 so as to reach a cavity 125 which is in communication, as can be seen in FIG. 2, with two internal ducts 126*a* and 126*b* opening to the outside of the pushbutton via vector gas outlet orifices 127*a* and 127*b*. The orifices 127*a* and 127*b* have axes Za and Zb that are substantially perpendicular to each other, for example, each being at an angle of about 45° relative to the spray direction, for example.

Figure 5:
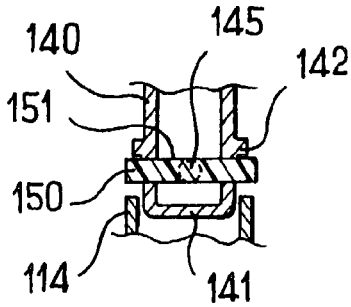
FIG. 5 is a view on a larger scale showing a detail V of FIG. 1.

The pushbutton 103 also has a substance feed orifice 130 having an axis Zc which coincides with the spray direction, for example. The orifice 130 communicates with the inside of a hollow rod 140, for example, which rod is closed at its bottom end by a wall 141, as can be seen in FIG. 5, and on which a shutter-forming annular gasket 150 is engaged, the gasket 150 being made of elastomer, for example.

In the example shown, the gasket 150 bears via its plane top face 151 against an annular rib 142 of the rod 140. The rod 140 has at least one substance admission orifice 145 whose diameter is less than or equal to the nominal thickness of the gasket 150 as measured along the axis of the rod 140. The orifice 145 is positioned in such a manner that the gasket 150, when bearing at rest against the rib 142, covers the orifice 145 completely and prevents the substance P contained in the cavity 105 from penetrating via the orifice 145 into the rod 140.

By way of example, the rod 140 is fixed via its top end in a housing 160 of the pushbutton 103 and can move together with the rod 120 when the user presses on the pushbutton 103. When the rod 140 is pushed down, the gasket 150 is compressed between the wall 114 and the rib 142 with such compression having the effect of reducing its thickness and releasing or uncovering the orifice 145, at least in part, so that the substance contained in the cavity 105 can flow through the orifice 145, up the rod 140, and reach the substance feed orifice 130.

When the pushbutton 103 is released, the rod 140 rises together with the pushbutton so the gasket 150 can return to a thickness which is sufficient for closing the orifice 145 because of the gasket's shape memory.

The device 100 operates as follows. To spray substance P, the user presses on the pushbutton 103, thereby pushing down the rod 121 of the valve on the receptacle and causing vector gas to be emitted into the passage inside the rod 120. The vector gas flows via the duct 126*a* and 126*b* so as to leave via the orifices 127*a* and 127*b*, thereby establishing suction in front of the substance feed orifice 130 by the Venturi effect. Pushing down the pushbutton 103 also has the effect of moving the rod 140 so as to compress the gasket 150 as explained above. The orifice 145 is then released at least in part and substance P contained in the cavity 105 can rise up the passage inside the rod 140 and reach the orifice 130 due to the effect of the above-mentioned suction. The substance is then sprayed along the direction of the axis Zc so long as the user continues to press on the pushbutton 103. When the pushbutton is released, it can rise back into its rest position because the control rod 121 is returned into its initial position by resilient means specific to the receptacle 101, and also because the gasket 150 has its own elasticity. By returning to its initial shape, the gasket closes the orifice 145 so that when the device 100 is carried about in a horizontal or an upside-down position, the substance P remains contained inside the cavity 105 and does leak out through the substance feed orifice 130.

By way of example, the receptacle 104 can be secured removably to the receptacle containing the vector gas, so as to make it possible, where appropriate, to change receptacle 104 when the supply of substance is used up. This can also enable the receptacle 101 to be replaced, or enable different substances to be sprayed in succession using a single receptacle 101.

In the embodiment corresponding to FIGS. 1 to 5, the substance feed is constituted by the end of a duct formed in the pushbutton. However it would not go beyond the scope of the present invention for the substance feed to include a material capable of absorbing the substance by capillary action or wicking, e.g., using a wick, a felt, or a sintered material.

It is also possible to use a plurality of supplies of different substances mounted in respective chambers of a rotary cylinder, in a manner similar to that described in French Patent Application No. FR-A-2 781 208, whose content is hereby incorporated by reference.

Naturally, the invention is not limited to the embodiments described above. In general, the above-described shutter can be replaced by any suitable shutter mechanism, e.g., the shutter mechanism shown in FIG. 6 with two coaxial walls 201 and 202 that are movable relative to each other and that constitute a shutter. By way of example, the inner wall 202 can be formed by a hollow rod secured to the pushbutton and closed at its bottom end. The substance can rise inside the rod when suction is established by emitting the vector gas. The outer wall 201 is stationary and it is configured to close an orifice 203 through the wall 202 when the pushbutton is at rest. The wall 202 has an orifice 204 configured to come into register with the orifice 103 when the pushbutton is pressed down, thereby at least partially releasing the orifice 203 so as to allow the substance to reach the substance feed.

A check valve, e.g., in the form of a ball, configured to open by moving the pushbutton can also be used, as shown in FIG. 7. Such a check valve can occupy a closed position when the pushbutton is released by the user. In the example shown, the check valve has a shutter-forming ball 210 urged into a shut position by a spring 211. An actuator rod 212 is adapted to move downwards when the pushbutton is pushed down. The substance can then flow via a duct 213 to reach the zone where the suction is established, in order to be sprayed.

In variant embodiments, the annular channel 107 can be omitted, e.g., if the substance is allowed to reach the space inside the wall 114, e.g., through openings formed in the wall and in the bottom end of the duct 114.

It would not go beyond the scope of the invention for the suction created by emitting the vector gas to be produced through a single orifice. Nor would it go beyond the ambit of the invention for the substance feed to include a substance feed member such as a felt, a foam, or a sintered member, as shown in FIG. 8. As seen in this figure, a felt tip 220 is configured to feed the substance by capillarity into the zone where suction is established, the felt tip being fixed in the above-mentioned orifice 130, for example.

The control rod 121 for the receptacle containing the vector gas can also cause the vector gas to be dispensed by being tilted relative to the axis W, providing the pushbutton is configured accordingly.

Figure 9:
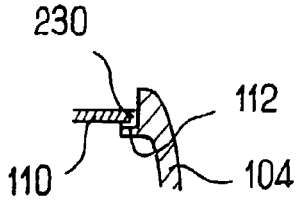
FIG. 9 is a diagram showing an example of a microleak.

The receptacle 104 can be made without an air intake, or with an air intake, in particular if extended use is envisaged. To enable air intake, it is possible, for example, to make a microleak 230, as shown in FIG. 9, through the cover 110 or between the cover and the wall 105*a* of the receptacle 104, which corresponds to the example shown in FIG. 9. Such a microleak is configured to prevent substance passing therethrough, in particular when the device is in a prone position, but to enable air to pass therethrough.

As shown in FIG. 10, a valve 240 configured to close an air intake orifice 241 can also be provided, for example. The valve 240 is opened in the event of a drop in pressure inside the receptacle containing the substance and closes the orifice 241 otherwise. The valve 240 can, for example, be overmolded onto the cover 110, but could also be made in some other way without going beyond the scope of the invention.

Obviously, numerous modifications and variations of the present invention are possible in light of the above teachings. It is therefore to be understood that within the scope of the appended claims, the invention can be practiced otherwise than as specifically described therein.

What is claimed as new and desired to be secured by Letters Patent of the United States is:

1. A device for spraying at least one substance onto a medium, the device comprising:

a supply of vector gas;

at least one substance feed that communicates with a supply of said substance, the substance being sucked from the supply of said substance by suction established in a vicinity of said at least one substance feed by emission of said vector gas;

at least one shutter that interrupts communication between said at least one substance feed and the supply of said substance; and at least two gas outlet orifices, from which said vector gas is emitted, said two gas outlet orifices being positioned such that a vector gas jet emitted from a first of said at least two gas outlet orifices meets another vector gas jet emitted from a second of said at least two gas outlet orifices, wherein the shutter comprises a gasket mounted on a hollow rod, the rod being closed at a bottom end, the gasket being capable of bearing via a top face against a shoulder of the rod, the rod having at least one substance admission orifice passing therethrough, the substance admission orifice being of a diameter that is smaller than or equal to the thickness of the gasket, said gasket being capable of coming into abutment via a bottom face against a stationary bearing wall when the hollow rod is pushed down, thereby causing the gasket to be compressed so as to open the substance admission orifice at least in part and enabling the substance to flow towards said at least one substance feed.

2. A device according to claim 1, wherein said vector gas jets meet in said vicinity of said at least one substance feed.

3. A device according to claim 2, wherein the gas outlet orifices are disposed symmetrically about a spray axis.

4. A device according to claim 3, wherein the substance feed comprises an orifice presenting an axis situated substantially in a same plane as axes of the gas outlet orifices.

5. A device according to claim 2, wherein axes of the gas outlet orifices are at angles of 45° relative to a spray axis.

6. A device according to claim 1, wherein the substance feed comprises at least one orifice.

7. A device according to claim 1, wherein the substance feed comprises at least one member which feeds the substance by capillarity.

8. A device according to claim 1, further comprising a mechanism that reestablishes communication automatically between said at least one substance feed and the supply of said substance while vector gas is being emitted from said at least two gas outlet orifices.

9. A device according to claim 1, further comprising a pushbutton which activates a vector gas dispenser valve and said at least one shutter, whereby communication between said at least one substance feed and the supply of said substance is established when the pushbutton causes the vector gas to be dispensed.

10. A device according to claim 9, wherein said pushbutton activates said vector gas dispenser valve by directly acting on said vector gas dispenser valve.

11. A device according to claim 9, wherein said pushbutton activates said vector gas dispenser valve by indirectly acting on said vector gas dispenser valve.

12. A device according to claim 1, further comprising a first receptacle containing said substance and providing said supply of said substance, said first receptacle being coupled to a second receptacle containing the vector gas and providing said supply of vector gas.

13. A device according to claim 12, wherein said first receptacle and said second receptacle are fixed to each other so as to prevent relative movement during use.

14. A device according to claim 12, wherein the first receptacle containing the substance is annular in shape and defines a passage through which a control member can extend for controlling a valve fitted to the second receptacle containing the vector gas.

15. A device according to claim 12, wherein the receptacle containing the substance is coupled to the receptacle containing the vector gas in a removable manner.

16. A device according to claim 1, wherein said at least one shutter is operationally connected to at least one element actuated by moving a pushbutton.

17. A device according to claim 16, wherein said element comprises a hollow rod having at least one inside passage enabling the substance to reach an orifice of said at least one substance feed.

18. A device according to claim 1, wherein the shutter comprises at least one gasket which closes at least one orifice through which the substance can flow to reach said at least one substance feed, and which uncovers said orifice at least in part while said substance is being dispensed.

19. A device according to claim 1, wherein the gasket bears via a periphery against an inside surface of a duct in which the hollow rod can move axially, the duct being capable of communicating freely with the outside.

20. A device according to claim 1, wherein the hollow rod is actuated by moving a pushbutton that controls emission of the vector gas.

21. A device according to claim 1, wherein space inside the bearing wall, against which the gasket can come into abutment via said bottom face, communicates with a receptacle containing the substance via an annular channel formed in a bottom end wall of said receptacle.

22. A device according to claim 1, further comprising a pushbutton having a bottom portion assembled to a top portion.

23. A device according to claim 22, wherein the bottom portion is integral with an actuator rod extending along a passage in a receptacle containing the substance and providing said supply of said substance.

24. A device according to claim 23, further comprising a control rod of a valve for delivering the vector gas, said control rod being engaged in the actuator rod.

25. A device according to claim 1, wherein the vector gas is contained in liquefied form in a vector gas receptacle providing said vector gas supply.

26. A device according to claim 1, wherein said substance is a liquid.

27. A device according to claim 1, wherein said substance is a powder.

28. A device according to claim 1, further comprising a receptacle containing said substance and providing said supply of said substance.

29. A device according to claim 28, wherein said receptacle defines a microleak.

30. A device according to claim 28, further comprising an air intake valve mounted on said receptacle.

31. A device according to claim 1, wherein the shutter comprises a gasket mounted on a hollow rod.

32. A device according to claim 31, wherein the rod is closed at a bottom end.

33. A device according to claim 32, wherein the gasket is capable of bearing via a top face against a shoulder of the rod.

34. A device according to claim 33, wherein the rod has at least one substance admission orifice passing therethrough.

35. A device according to claim 34, wherein the substance admission orifice is of a diameter that is smaller than or equal to the thickness of the gasket.

36. A device according to claim 35, wherein said gasket is capable of coming into abutment via a bottom face against a stationary bearing wall when the hollow rod is pushed down.

37. A device for dispensing a substance, comprising:

a first receptacle containing said substance and defining a substance opening in communication with a substance orifice from which said substance is emitted outside said device;

a first member movable with respect to said substance opening, said first member fully covering said substance opening in a first position and at least partly uncovering said substance opening in a second position;

a second receptacle containing a gas and defining a gas opening in communication with a gas outlet from which said gas is emitted outside said device, said gas outlet being distinct from said substance orifice;

a second member movable with respect to said gas opening, said second member fully covering said gas opening in a first position and at least partly uncovering said gas opening in a second position; and a pushbutton coupled to said first member and to said second member, wherein said first and second members are in their respective first positions when said pushbutton is not pushed and wherein said first and second members move in their respective second positions when said pushbutton is pushed.

38. A device according to claim 37, wherein said gas opening is in communication with two gas outlets from which said gas is emitted outside said device.

39. A device according to claim 37, wherein said gas outlet is in a vicinity of said substance orifice so that gas emitted from said gas outlet creates a suction at the substance orifice.

40. A device according to claim 39, wherein said first member comprises a gasket mounted on a rod coupled to said pushbutton at a first rod end.

41. A device according to claim 40, wherein said rod is hollow and closed at a second rod end.

42. A device according to claim 40, wherein a diameter of said substance opening is smaller than a thickness of said gasket.

43. A device according to claim 37, wherein said second member includes a valve coupled to a valve control rod coupled to said pushbutton.

44. A device according to claim 43, wherein said valve control rod is hollow and coupled to said valve at a first end and coupled to a hollow actuator rod at a second end.

45. A device according to claim 44, wherein said hollow actuator rod is coupled to said pushbutton.

46. A device according to claim 45, wherein said hollow actuator rod is integral with said pushbutton.

47. A device for dispensing a substance, comprising:

a gas receptacle;

a substance receptacle mounted on said gas receptacle;

a pushbutton mounted on said substance receptacle;

a substance orifice defined by said pushbutton and in communication with said substance receptacle; and two gas orifices defined by said pushbutton and in communication with said gas receptacle;

wherein said substance orifice and said two gas orifices are within a same plane.

48. A device according to claim 47, wherein said substance orifice is positioned between said two gas orifices.

49. A device according to claim 47, wherein said substance orifice communicates with said substance receptacle in part via a radial duct defining a spray axis.

50. A device according to claim 49, wherein said gas orifices communicate with said gas receptacle in part via gas ducts having axes perpendicular to each other.

51. A device according to claim 50, wherein said gas ducts axes are at 45° with respect to said spray axis.

52. A device according to claim 50, wherein said ducts communicate with an axial duct having an axis parallel to an axis of said pushbutton.

53. A device according to claim 52, wherein said axial duct is coaxial with said axis of said pushbutton.

54. A device according to claim 49, wherein said radial duct communicates with an axial duct having an axis parallel to an axis of said pushbutton.

55. A device according to claim 54, wherein said axis of said axial duct is offset from said axis of said pushbutton.

56. A device for spraying at least one substance onto a medium, the device comprising:

a supply of vector gas;

at least one substance feed that communicates with a supply of said substance, the substance being sucked from the supply of said substance by suction established outside said device in a vicinity of said at least one substance feed by emission of said vector gas;

at least one shutter that interrupts communication between said at least one substance feed and the supply of said substance; and at least one gas outlet orifice, from which said vector gas is emitted outside said device, said at least one gas outlet orifice being located in said vicinity of said at least one substance feed;

wherein the shutter comprises a gasket mounted on a hollow rod, the rod being closed at a bottom end, the gasket being capable of bearing via a top face against a shoulder of the rod, the rod having at least one substance admission orifice passing therethrough, the substance admission orifice being of a diameter that is smaller than or equal to the thickness of the gasket, said gasket being capable of coming into abutment via a bottom face against a stationary bearing wall when the hollow rod is pushed down, thereby causing the gasket to be compressed so as to open the substance admission orifice at least in part and enabling the substance to flow towards said at least one substance feed.

* * * * *